US007374499B2

(12) United States Patent
Jones et al.

(10) Patent No.: US 7,374,499 B2
(45) Date of Patent: May 20, 2008

(54) GOLF CLUB HEAD WITH DUAL DUROMETER FACE INSERT

(75) Inventors: David D. Jones, Phoenix, AZ (US); Leslie J. Bryant, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 294 days.

(21) Appl. No.: 11/194,959

(22) Filed: Aug. 1, 2005

(65) Prior Publication Data

US 2007/0026964 A1 Feb. 1, 2007

(51) Int. Cl.
*A63B 53/04* (2006.01)

(52) U.S. Cl. ..... 473/340; 473/342; 473/329

(58) Field of Classification Search ..... None
See application file for complete search history.

(56) References Cited

U.S. PATENT DOCUMENTS

| | | | | |
|---|---|---|---|---|
| 5,431,396 | A | 7/1995 | Shieh | |
| 5,447,311 | A * | 9/1995 | Viollaz et al. | 473/342 |
| 5,921,871 | A | 7/1999 | Fisher | |
| 6,042,486 | A * | 3/2000 | Gallagher | 473/329 |
| 6,238,302 | B1 | 5/2001 | Helmstetter et al. | |
| 6,273,831 | B1 * | 8/2001 | Dewanjee | 473/324 |
| 6,375,583 | B1 | 4/2002 | Solheim | |
| 6,478,694 | B2 | 11/2002 | Anderson | |
| 6,729,972 | B2 | 5/2004 | Boord | |
| 2005/0119069 | A1 | 6/2005 | Guard | |

FOREIGN PATENT DOCUMENTS

| | | |
|---|---|---|
| GB | 2268412 | 12/1994 |
| WO | WO99/25427 | 5/1999 |

* cited by examiner

*Primary Examiner*—Alvin A. Hunter
(74) *Attorney, Agent, or Firm*—Darrell F. Marquette; John D. Titus

(57) ABSTRACT

A golf club head includes a face insert that comprises an insert core made of a relatively hard (high durometer) durable polymer material that is surrounded on at least its rear and side surfaces by an insert shell made of a second softer (lower durometer) polymer material. The insert shell allows the harder insert core to "float" within a cavity in the club head while being surrounded on all sides by the softer insert shell. This arrangement of the insert core and the insert shell thus provides the advantages of a durable impact surface for desirable acoustic feedback while at the same time resulting in desirable feel due to the softer insert shell surrounding the harder insert core.

13 Claims, 2 Drawing Sheets

GOLF CLUB HEAD WITH DUAL DUROMETER FACE INSERT

BACKGROUND OF THE INVENTION

This invention relates generally to golf equipment and, in particular, to a golf club head having a face insert.

It is generally accepted among golfers that the tactile feedback to the golfer's hands (the "feel" of a club) is improved for many clubs by the incorporation of a properly engineered polymer insert in the striking face of the club. Softer polymers produce a desirable soft feel but generally suffer from poor durability. Harder polymers have good durability and produce a more pleasing acoustic feedback but lack the soft feel of the less durable soft polymers.

U.S. Pat. No. 5,921,871 to Fisher ("the '871 patent") discloses a golf putter head in which the striking face is formed by a laminate consisting of a plurality of pads that provide different hardnesses to suit different strokes of different golfers. The laminates are bonded together by adhesive layers and, therefore, the vibration dampening characteristics of the laminates are degraded by the intervening adhesive layers. Additionally, the laminate forming the striking face is in direct contact with the metal club head and, therefore, not fully isolated from the metal club head.

U.S. Pat. No. 6,238,302 to Helmstetter, et al. ("the '302 patent") discloses a golf club head with a polymer face insert. The face insert is disposed in a cavity formed in the club head face. The insert has a plurality of tabs formed on its perimeter edge that engage the walls of the cavity to center the insert in the cavity. The insert is installed by bonding it to the club head using an adhesive disposed in the cavity. During assembly, as the insert is placed in the cavity, the tabs permit air and any excessive adhesive to escape the cavity through the gaps through the tabs, thereby promoting a good structural bond between the insert and the golf club head. The insert is formed of a single polymer and, therefore, the material choice must necessarily be a compromise between a harder material with greater durability and a softer material with a better feel. U.S. Pat. No. 6,729,972 to Boord ("the '972 patent") discloses a putter having a face insert formed of at least two laminates. The outer laminate is transparent so as to reveal indicia printed on the immediately underlying laminate. As with the '871 patent, the laminate forming the striking surface is in direct contact with the metal club head along its perimeter surface and, therefore, is not fully isolated from the club head body.

SUMMARY OF THE INVENTION

The present invention comprises a golf club head including a body having a front surface with a cavity formed therein. A face insert is mounted in the cavity. In an illustrative embodiment of the present invention, the face insert comprises an insert core that is made of a relatively hard (high durometer) durable polymer material that is surrounded on at least its rear and side surfaces by an insert shell made of a second softer (lower durometer) polymer material. The insert shell allows the harder insert core to "float" within the body cavity surrounded on all sides by the softer insert shell. This arrangement of the insert core and the insert shell provides the advantages of a durable impact surface for desirable acoustic feedback while at the same time resulting in desirable feel due to the softer insert shell surrounding the harder insert core.

DESCRIPTION OF THE DRAWINGS

The present invention will be better understood from a reading of the following detailed description, taken in conjunction with the accompanying drawing figures in which like references designate like elements, and in which.

DESCRIPTION OF THE INVENTION

Figure 1:
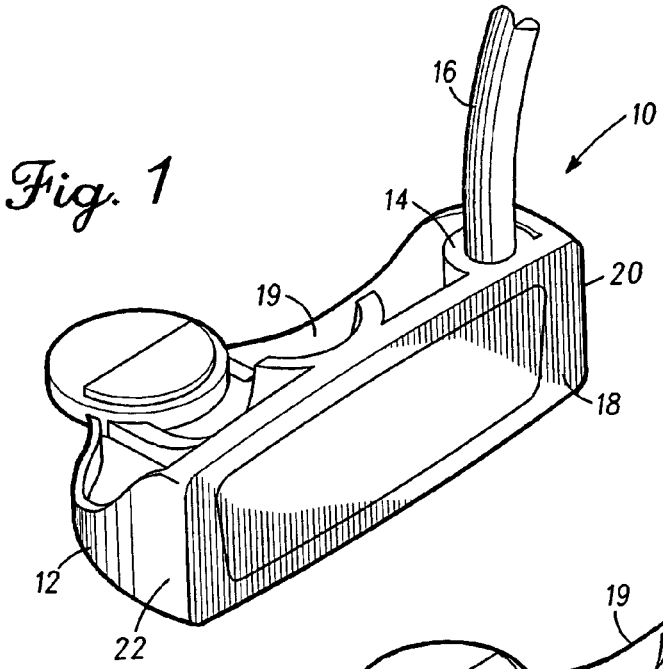
FIG. 1 is a front perspective view of a golf club head incorporating features of the present invention.

The drawing figures are intended to illustrate the general manner of construction and are not necessarily to scale. In the description and in the drawing figures, specific illustrative examples are shown and herein described in detail. It should be understood, however, that the drawing figures and detailed description are not intended to limit the invention to the particular form disclosed but are merely illustrative and intended to teach one of ordinary skill how to make and/or use the invention claimed herein and for setting forth the best mode for carrying out the invention.

Figure 2:
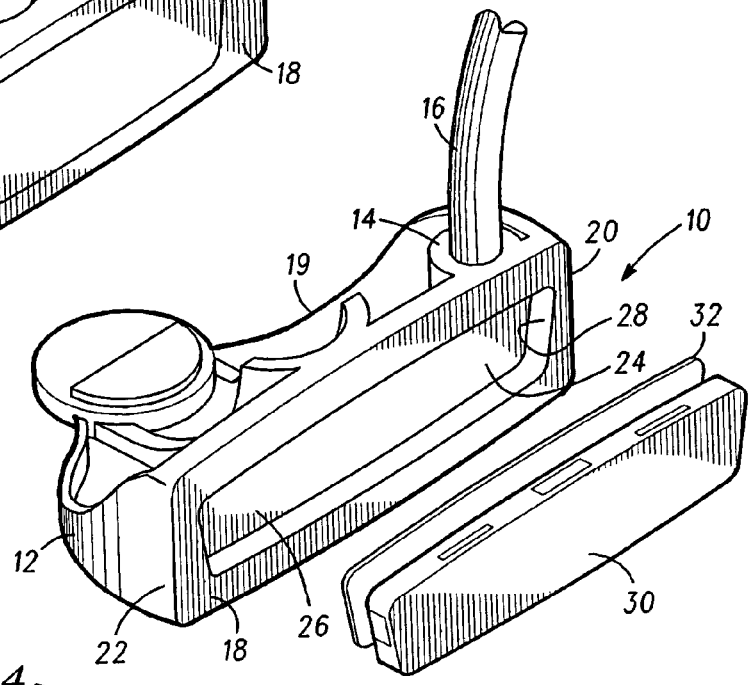
FIG. 2 is a front exploded perspective view of the golf club head of FIG. 1.

With reference to FIGS. 1 and 2, a golf club head 10, preferably a golf putter head, comprises a body 12 and a hosel 14 for receiving one end of a golf club shaft 16. The body 12 has a front surface 18, a rear surface 19, a heel region 20 and a toe region 22. The front surface 18 has a cavity 24 formed therein defined by a bottom wall 26 and a side wall 28.

The body 12, including the cavity 24, is typically formed by an investment casting process. The bottom wall 26 and side wall 28 are then shaped by a milling process to maintain precise tolerances. The body 12 is preferably made of suitable metal material such as steel or bronze. A face insert 30 is disposed in the cavity 24 and secured thereto by an adhesive layer 32 disposed between bottom wall 26 and face insert 30.

Figure 3:
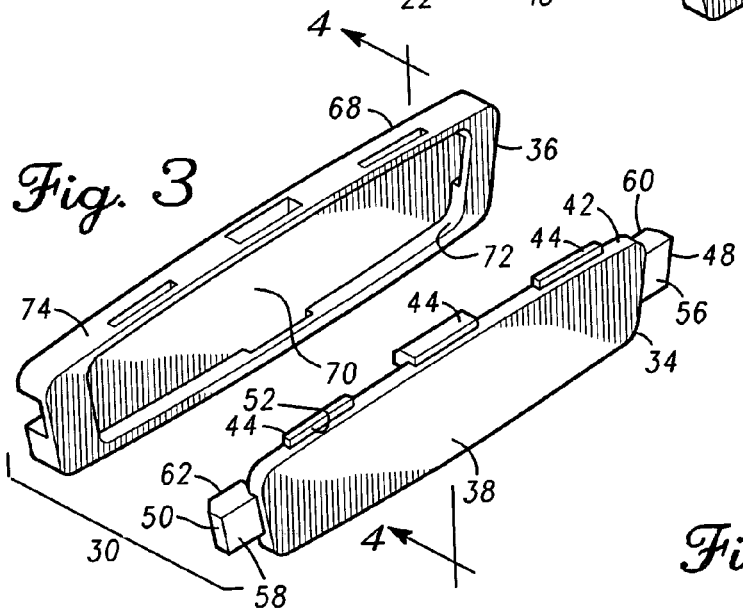
FIG. 3 is a front exploded perspective view of a face insert incorporating features of the present invention.
Figure 4:
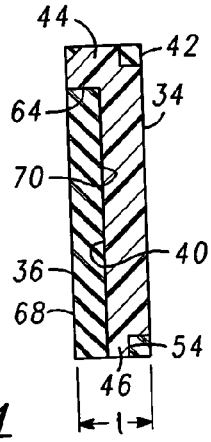
FIG. 4 is a cross-section of the face insert of FIG. 3 taken along line 4-4.

As shown more fully in FIGS. 3 and 4, face insert 30 comprises an insert core 34 and an insert shell 36. Insert core 34 is preferably formed of a polyurethane material having a relatively higher hardness, preferably a hardness greater than 60D durometer, more preferably between 60D and 80D, most preferably about 72D and is formed by a conventional injection molding process. Insert core 34 includes a forward surface 38, a rearward surface 40 and a perimeter surface 42. Insert core 34 is formed with a plurality of integral tabs including crown tabs 44, sole tab 46, heel tab 48 and toe tab 50. The front surfaces 52, 54, 56 and 58 of crown tabs 44, sole tab 45, heel tab 48 and toe tab 50, respectively are stepped rearward from forward surface 38 of insert core 34 by approximately ¼ to 1½ the thickness of insert core 34 measured from the forward surface 38 to the rearward surface 40 of insert core 34. The rear surface 60 of heel tab 48, rear surface 62 of toe tab 58 and rear surface 64 of at least one of the crown tabs 44 extend rearward of rearward surface 40 of insert core 34 and are coplanar for reasons that will be discussed more fully hereinafter.

Insert shell 36 is preferably formed of a polymer having a hardness that is less than the hardness of insert core 34, preferably less than 60D, more preferably between 55D and 45D, and most preferably about 52D durometer and is formed by an injection molding process as described more fully hereinafter. Insert shell 36 surrounds and substantially encapsulates at least the rearward surface 40 and perimeter surface 42 of insert core 34 as well as crown tabs 44, sole tab 46, heel tab 48, and toe tab 50. Insert shell 36 has an exterior surface 68 that is in contact with adhesive 32 when face insert 30 is assembled to body 12. Insert shell 36 further comprises an interior surface 70 that is in contact with rearward surface 40 of insert core 34 as well as a side surface 72 that is in contact with and surrounds perimeter surface 42 of insert core 34. The border surface 74 of insert shell 36 contacts side wall 28 of body 12 when insert 30 is assembled in body 12.

Figure 5:
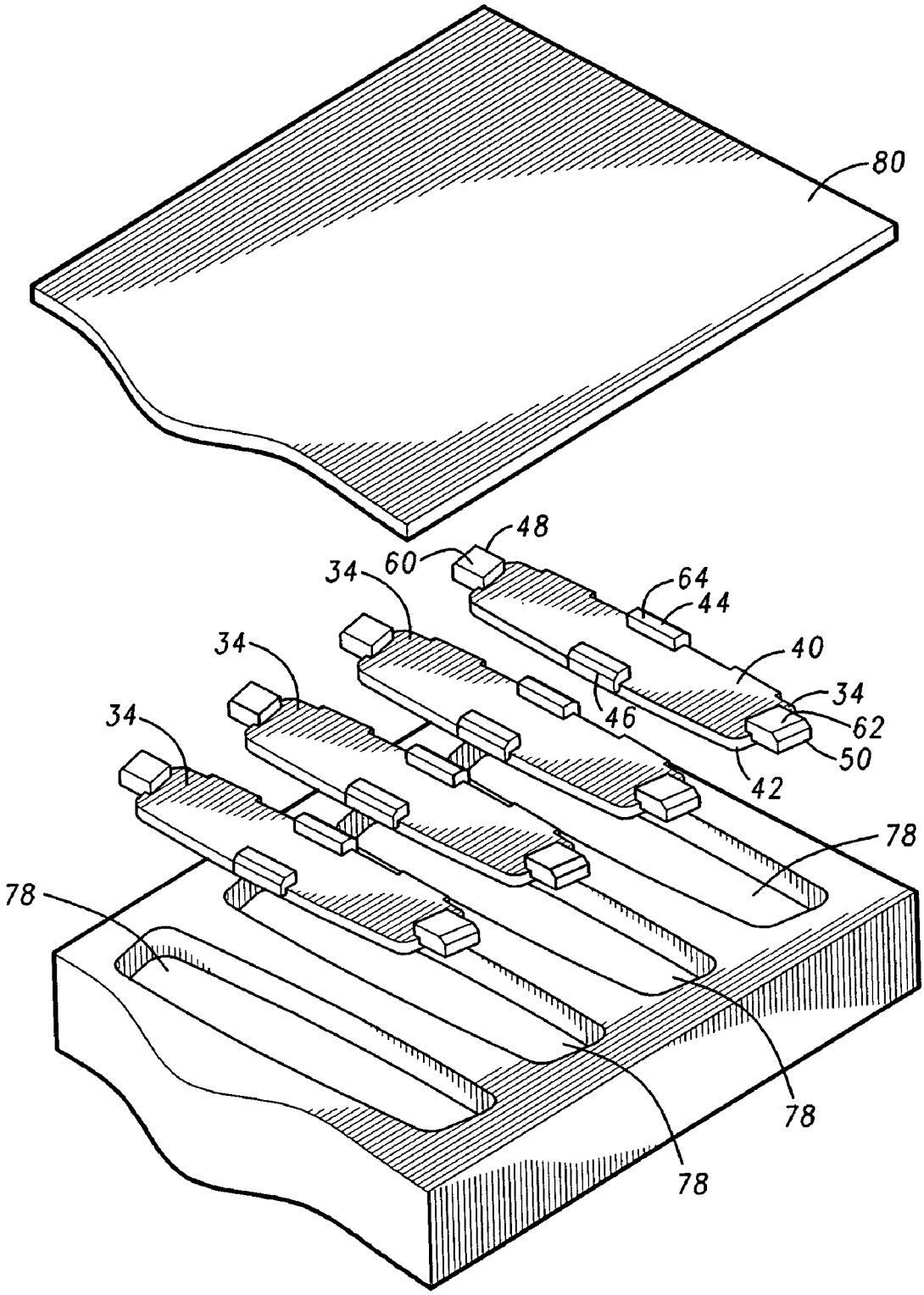
FIG. 5 is a perspective view of a multi-cavity mold used for manufacturing the face insert of FIGS. 3-4.

With further reference to FIG. 5, face insert 30 is formed by placing insert core 34 in a mold cavity 78 having a depth equal to the depth "t" of the finished face insert 30. Crown tab 44, sole tab 46, heel tab 48, and toe tab 50 center insert core 34 within mold cavity 78 and position insert core 34 within mold cavity 78 so that the volume between crown tabs 44, sole tab 46, heel tab 48 toe tab 50 and rearward surface 40, as well as the region surrounding perimeter surface 42 of insert core 34 can be filled with the material that comprises insert shell 36. When the mold is closed by mold cover 80, the coplanar surfaces 60, 62, and 64 of crown tabs 44, heel tab 48 and toe tab 50 exert sufficient pressure to force forward surface 38 against the mold (either against the bottom of mold cavity 78 or against mold cover 80, depending on the orientation of insert core 34 in the mold) so that at the injection pressures and temperatures utilized for injecting the material comprising insert shell 36, the material flows around rather than over the forward surface 38 of insert core 34 leaving it exposed when the finished part is removed from the mold cavity.

Alternatively, the tabs 44, 46, 48 and 50 could be replaced by a plurality of retractable pins (not shown) in the mold cavities 78. These retractable pins would retract during the molding process of the face insert 30 so that the harder insert core 34 is completely encapsulated by the softer insert shell 36.

What is claimed is:

1. A golf club head comprising:

a body having a heel region, a toe region, a back surface and a front surface with a cavity formed therein, the cavity having a bottom wall proximal the back surface of the body and a side wall defining a depth dimension of the cavity;

a face insert disposed within the recess, said face insert comprising, an insert core made of a first material, said insert core comprising a body having a forward surface proximal the front surface of the body, a rearward surface proximal the bottom surface of the cavity, and a perimeter surface defining a depth dimension of said insert core, the forward surface of said insert core forming a striking surface adapted for impacting a golf ball; and an insert shell made of a second material softer than said first material, said insert shell surrounding and substantially encapsulating at least the rearward surface and the perimeter surface of said insert core; said insert shell having an exterior surface adjacent the bottom wall of the cavity, an interior surface adjacent the rearward surface of said insert core, and a border surface defining a depth dimension of said insert shell, wherein said insert core includes a plurality of tabs substantially encapsulated by said insert shell, said plurality of tabs extending rearward and radially outward from a perimeter region of said insert core, said plurality of tabs defining a volume between the bottom wall of the cavity and the rearward surface of said insert core, said volume being filled with the second material forming a part of said insert shell.

2. The golf club head of claim 1, wherein:

said insert core has hardness value greater than 60D Durometer.

3. The golf club head of claim 1, wherein:

said insert shell has a hardness value no greater than 60D Durometer.

4. The golf club head of claim 1, wherein:

the thickness dimension of said insert shell is at least one quarter the thickness dimension of said insert core when measured proximal the center of said face insert.

5. The golf club head of claim 1, wherein:

the forward surface of said insert core and the interior surface of said insert shell are substantially planar.

6. The golf club head of claim 1, wherein:

said plurality of tabs have forward surfaces located rearward of the forward surface of said insert core.

7. The golf club head of claim 6, wherein:

the forward surfaces of the tabs are stepped rearward of the forward surface of said insert core.

8. A method of manufacturing a golf club head comprising:

providing a body having a heel region, a toe region, a back surface and a front surface with a cavity formed therein, the cavity having a bottom wall proximal the back surface of the club head body and a side wall defining a depth dimension of the cavity, forming an insert core made of a first material, the insert core comprising a body having a forward surface, a rearward surface and a perimeter surface defining a depth dimension of said insert core, the insert core having a plurality of tabs extending rearward and radially outward from a perimeter region of said insert core;

forming a face insert assembly by molding a second material softer than said first material around the insert core to form an insert shell that substantially encapsulates at least the rearward surface and the perimeter surface of the insert core, the insert shell comprising an exterior surface, an interior surface and a border surface, the interior surface being in contact with the rearward surface and the perimeter surface of the insert core;

placing the face insert assembly in the cavity formed in the body so that the exterior surface of the insert shell is adjacent the bottom surface of the cavity;

applying adhesive within the recess in contact with the exterior surface of the insert shell and the bottom wall of the cavity for retaining said face insert assembly within the cavity.

9. The method of claim 8, wherein:

the step of molding the second material comprises placing the insert core in a mold having a mold cavity with a mold side wall corresponding to the border surface of the insert shell, the mold further comprising a mold face corresponding to the exterior surface of the insert shell; and injection molding the second material into the mold cavity.

10. The method of claim 8, wherein:

said insert core has a hardness value greater than 60B Durometer.

11. The golf club head of claim 8, wherein:

said insert shell has a hardness value no greater than 60B Durometer.

12. The method of claim 8, further comprising:

forming forward surfaces of the tabs rearward of the forward surface of said insert core.

13. The method of claim 12, wherein:

the forward surfaces of the tabs are stepped rearward of the forward surface of said insert core.

* * * * *